US008776394B2

(12) United States Patent
Catauro et al.

(10) Patent No.: US 8,776,394 B2
(45) Date of Patent: Jul. 15, 2014

(54) BLOWER FOR A LAUNDRY TREATING APPLIANCE

(75) Inventors: Michael J. Catauro, Watervliet, MI (US); Mark J. Christensen, Benton Harbor, MI (US); Steven P. Lentz, Holland, MI (US); Roy E. Masters, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 343 days.

(21) Appl. No.: 13/252,230

(22) Filed: Oct. 4, 2011

(65) Prior Publication Data

US 2013/0081296 A1 Apr. 4, 2013

(51) Int. Cl.
*F26B 11/02* (2006.01)

(52) U.S. Cl.
USPC ..... 34/601; 34/606; 34/610; 310/63; 416/183; 417/371; 415/214.1

(58) Field of Classification Search
USPC ..... 34/130, 601, 606, 610; 218/62, 63; 74/93, 372.1; 482/52; 416/60, 183; 417/371, 423.14; 415/119, 204, 206, 415/214.1
See application file for complete search history.

(56) References Cited

U.S. PATENT DOCUMENTS

| | | | | | |
|---|---|---|---|---|---|
| 2,041,555 | A * | 5/1936 | Lee | 416/134 R |
| 2,252,181 | A * | 8/1941 | Hunter et al. | 34/122 |
| 3,312,389 | A * | 4/1967 | Masayuki | 415/119 |
| 3,906,266 | A * | 9/1975 | Cowman | 310/60 R |
| 4,115,030 | A * | 9/1978 | Inagaki et al. | 416/93 R |
| 4,174,020 | A * | 11/1979 | Challis | 181/211 |
| 4,697,358 | A * | 10/1987 | Kitchen | 34/191 |
| 5,714,819 | A * | 2/1998 | Gilliland et al. | 310/91 |
| 5,735,669 | A | 4/1998 | Niemela | |
| 5,915,922 | A | 6/1999 | Wiethe et al. | |
| 6,439,843 | B1 * | 8/2002 | Finkenbinder | 415/172.1 |
| 6,511,288 | B1 * | 1/2003 | Gatley, Jr. | 415/206 |
| 6,695,581 | B2 | 2/2004 | Wasson et al. | |
| 7,091,635 | B1 | 8/2006 | Gilliland et al. | |
| 7,093,378 | B2 * | 8/2006 | Jeong et al. | 34/601 |
| 7,217,226 | B2 * | 5/2007 | Wasson et al. | 482/54 |
| 8,051,578 | B2 * | 11/2011 | Kohlrusch | 34/381 |
| 8,093,773 | B2 * | 1/2012 | Hu | 310/74 |
| 8,310,124 | B2 * | 11/2012 | Davis et al. | 310/168 |
| 8,333,019 | B2 * | 12/2012 | Gossel et al. | 34/604 |
| 2006/0063648 | A1 * | 3/2006 | Ko | 482/54 |
| 2013/0081296 | A1 * | 4/2013 | Catauro et al. | 34/130 |

FOREIGN PATENT DOCUMENTS

| | | | | |
|---|---|---|---|---|
| DE | 3141245 | A1 * | 4/1983 | F04D 19/00 |
| DE | 4127134 | A1 | 2/1993 | |
| DE | 102005053548 | A1 * | 5/2007 | H02K 7/00 |
| DE | 102006030780 | A1 | 5/2007 | |
| DE | 102006017368 | A1 | 10/2007 | |
| DE | 102008017818 | A1 | 10/2009 | |
| DE | 102010011526 | A1 | 9/2011 | |
| DE | 102011009258 | A1 | 9/2011 | |
| EP | 96255 | A1 * | 12/1983 | F04D 29/32 |
| EP | 1783374 | A1 * | 5/2007 | F04D 29/28 |
| JP | 58044298 | A * | 3/1983 | F04D 29/32 |
| JP | 04012198 | A * | 1/1992 | F04D 25/08 |

OTHER PUBLICATIONS

German Search Report for counterpart DE102012107131, Feb. 14, 2013.

* cited by examiner

*Primary Examiner* — Steve M Gravini

(57) ABSTRACT

A blower for supplying and exiting the air to and from a treating chamber of a clothes dryer.

20 Claims, 6 Drawing Sheets

BLOWER FOR A LAUNDRY TREATING APPLIANCE

BACKGROUND OF THE INVENTION

Laundry treating appliances may have a configuration in which a motor may be provided for driving one or more components to treat laundry in accordance with a cycle of operation. For example, in the case of a clothes dryer, a motor may be operably coupled to a blower to form a blower assembly that supplies or exhausts air to or from the treating chamber to treat the laundry load.

SUMMARY

A blower assembly having an electric motor with an output shaft; a wheel having a central hub and a peripheral rim, with the hub having a through opening receiving the output shaft of the motor, and a centerline of the opening defining an axis of rotation of the wheel; a plurality of vanes projecting from the rim and spaced radially about the rim; and an inertial weight mounted to the wheel and circumscribing the hub and having at least a portion radially spaced from the axis of rotation.

DESCRIPTION OF EMBODIMENTS OF THE INVENTION

Figure 1:
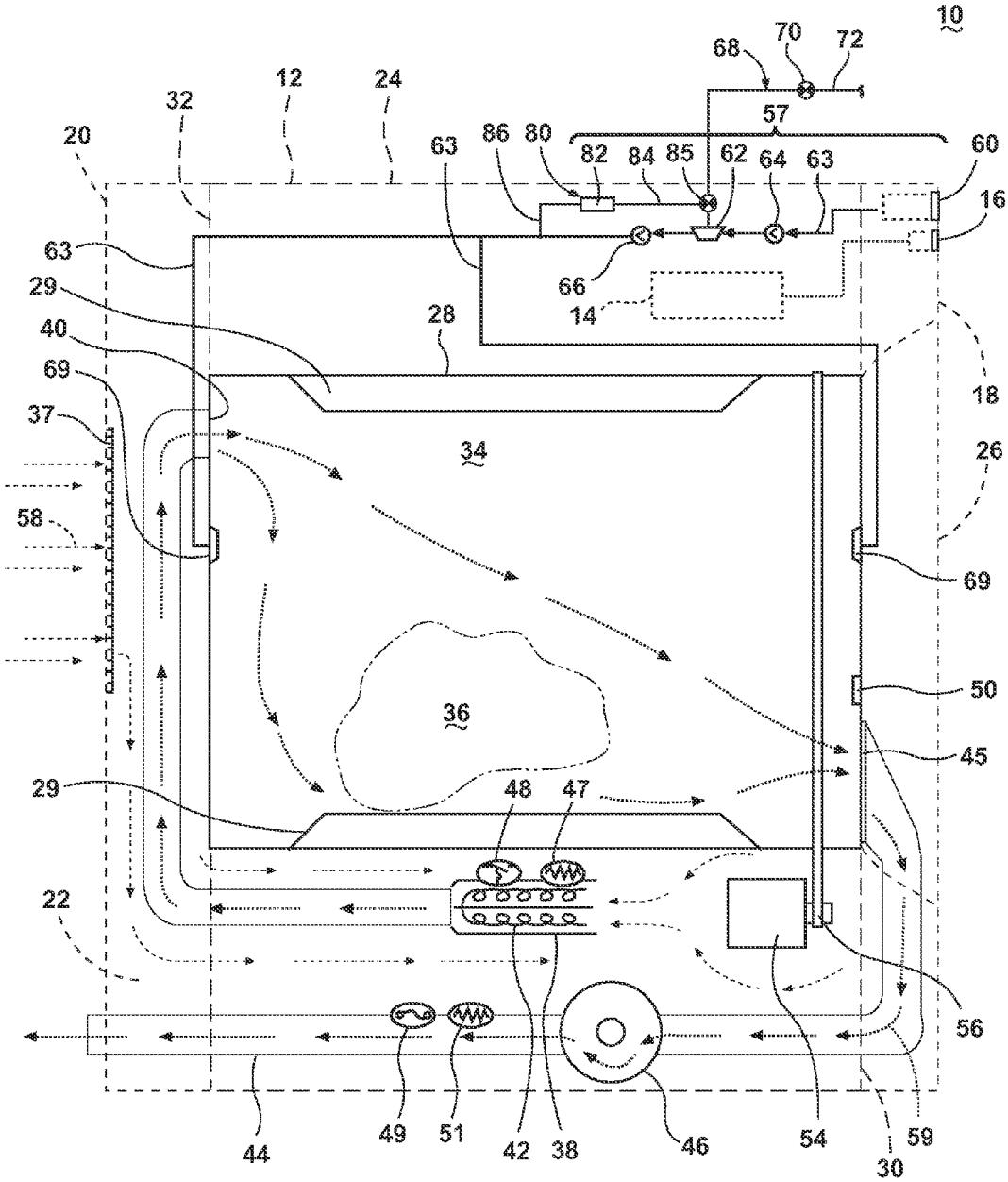
FIG. 1 is a schematic view of a laundry treating appliance in the form of a clothes dryer according to one embodiment of the invention.

FIG. 1 is a schematic view of a laundry treating appliance 10 in the form of a clothes dryer 10 that may be controlled according to one embodiment of the invention. The clothes dryer 10 described herein shares many features of a traditional automatic clothes dryer, which will not be described in detail except as necessary for a complete understanding of the invention. While the embodiments of the invention are described in the context of a clothes dryer 10, the embodiments of the invention may be used with any type of laundry treating appliance, non-limiting examples of which include a laundry washing machine, a clothes dryer, a combination washing machine and dryer and a refreshing/revitalizing machine.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation.

The cabinet 12 may be defined by a front wall 18, a rear wall 20, and a pair of side walls 22 supporting a top wall 24. A chassis may be provided with the walls being panels mounted to the chassis. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary front and rear bulkheads 30, 32, which, along with the door 26, collectively define a treating chamber 34 for treating laundry. As illustrated, and as is the case with most clothes dryers, the treating chamber 34 is not fluidly coupled to a drain. Thus, any liquid introduced into the treating chamber 34 may not be removed merely by draining.

Non-limiting examples of laundry that may be treated according to a cycle of operation include, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be treated in the clothes dryer 10.

The drum 28 may include at least one lifter 29. In most dryers, there may be multiple lifters. The lifters may be located along an inner surface of the drum 28 defining an interior circumference of the drum 28. The lifters may facilitate movement of the laundry 36 within the drum 28 as the drum 28 rotates.

The drum 28 may be operably coupled with a motor 54 to selectively rotate the drum 28 during a cycle of operation. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled to a hub of the drum 28.

An air system may be provided to the clothes dryer 10. The air system supplies air to the treating chamber 34 and exhausts air from the treating chamber 34. The supplied air may be heated or not. The air system may have an air supply portion that may form, in part, a supply conduit 38, which has one end open to ambient air via a rear vent 37 and another end fluidly coupled to an inlet grill 40, which may be in fluid communication with the treating chamber 34.

A heating system may be provided to heat the air supplied by the heating system. The heating system may include a heating element 42 lying within the supply conduit 38 and may be operably coupled to and controlled by the controller 14. If the heating element 42 is turned on, the supplied air will be heated prior to entering the drum 28.

The air system may further include an air exhaust portion that may be formed in part by an exhaust conduit 44. A lint trap 45 may be provided as the inlet from the treating chamber 34 to the exhaust conduit 44. A blower assembly 46 may be fluidly coupled to the exhaust conduit 44, and operably coupled to the motor 54. The blower assembly 46 may be also operably coupled to and controlled by the controller 14. Operation of the blower assembly 46 draws air into the treating chamber 34 as well as exhausts air from the treating chamber 34 through the exhaust conduit 44. The exhaust conduit 44 may be fluidly coupled with a household exhaust duct (not shown) for exhausting the air from the treating chamber 34 to the outside of the clothes dryer 10.

The air system may further include various sensors and other components, such as a thermistor 47 and a thermostat 48, which may be coupled to the supply conduit 38 in which the heating element 42 may be positioned. The thermistor 47 and the thermostat 48 may be operably coupled to each other. Alternatively, the thermistor 47 may be coupled to the supply conduit 38 at or near to the inlet grill 40. Regardless of its location, the thermistor 47 may be used to aid in determining an inlet temperature. A thermistor 51 and a thermal fuse 49 may be coupled to the exhaust conduit 44, with the thermistor 51 being used to determine an outlet air temperature.

A moisture sensor 50 may be positioned in the interior of the treating chamber 34 to monitor the amount of moisture of the laundry in the treating chamber 34. One example of a moisture sensor 50 is a conductivity strip. The moisture sensor 50 may be operably coupled to the controller 14 such that the controller 14 receives output from the moisture sensor 50. The moisture sensor 50 may be mounted at any location in the interior of the dispensing dryer 10 such that the moisture sensor 50 may be able to accurately sense the moisture content of the laundry. For example, the moisture sensor 50 may be coupled to one of the bulkheads 30, 32 of the drying chamber 34 by any suitable means.

A dispensing system 57 may be provided to the clothes dryer 10 to dispense one or more treating chemistries to the treating chamber 34 according to a cycle of operation. As illustrated, the dispensing system 57 may be located in the interior of the cabinet 12 although other locations are also possible. The dispensing system 57 may be fluidly coupled to a water supply 68. The dispensing system 57 may be further coupled to the treating chamber 34 through one or more nozzles 69. As illustrated, nozzles 69 are provided to the front and rear of the treating chamber 34 to provide the treating chemistry or liquid to the interior of the treating chamber 34, although other configurations are also possible. The number, type and placement of the nozzles 69 are not germane to the invention.

As illustrated, the dispensing system 57 may include a reservoir 60, which may be a cartridge, for a treating chemistry that is releasably coupled to the dispensing system 57, which dispenses the treating chemistry from the reservoir 60 to the treating chamber 34. The reservoir 60 may include one or more cartridges configured to store one or more treating chemistries in the interior of cartridges.

A mixing chamber 62 may be provided to couple the reservoir 60 to the treating chamber 34 through a supply conduit 63. Pumps such as a metering pump 64 and delivery pump 66 may be provided to the dispensing system 57 to selectively supply a treating chemistry and/or liquid to the treating chamber 34 according to a cycle of operation. The water supply 68 may be fluidly coupled to the mixing chamber 62 to provide water from the water source to the mixing chamber 62. The water supply 68 may include an inlet valve 70 and a water supply conduit 72. It is noted that, instead of water, a different treating chemistry may be provided from the exterior of the clothes dryer 10 to the mixing chamber 62.

The treating chemistry may be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

The dryer 10 may also be provided with a steam generating system 80 which may be separate from the dispensing system 57 or integrated with portions of the dispensing system 57 for dispensing steam and/or liquid to the treating chamber 34 according to a cycle of operation. The steam generating system 80 may include a steam generator 82 fluidly coupled with the water supply 68 through a steam inlet conduit 84. A fluid control valve 85 may be used to control the flow of water from the water supply conduit 72 between the steam generating system 80 and the dispensing system 57. The steam generator 82 may further be fluidly coupled with the one or more supply conduits 63 through a steam supply conduit 86 to deliver steam to the treating chamber 34 through the nozzles 69. Alternatively, the steam generator 82 may be coupled with the treating chamber 34 through one or more conduits and nozzles independently of the dispensing system 57.

The steam generator 82 may be any type of device that converts the supplied liquid to steam. For example, the steam generator 82 may be a tank-type steam generator that stores a volume of liquid and heats the volume of liquid to convert the liquid to steam. Alternatively, the steam generator 82 may be an in-line steam generator that converts the liquid to steam as the liquid flows through the steam generator 82.

It will be understood that the details of the dispensing system 57 and steam generating system 80 are not germane to the embodiments of the invention and that any suitable dispensing system and/or steam generating system may be used with the dryer 10. It is also within the scope of the invention for the dryer 10 to not include a dispensing system or a steam generating system.

Figure 2:
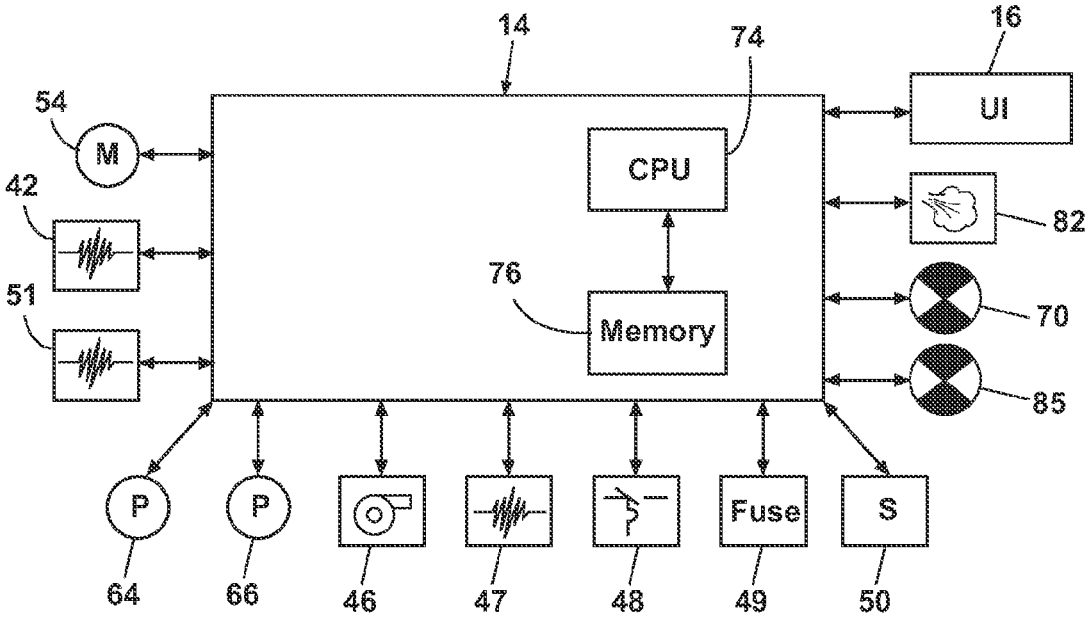
FIG. 2 is a schematic view of a controller of the clothes dryer in FIG. 1.

FIG. 2 is a schematic view of the controller 14 coupled to the various components of the dryer 10. The controller 14 may be communicably coupled to components of the clothes dryer 10 such as the heating element 42, blower assembly 46, thermistor 47, thermostat 48, thermal fuse 49, thermistor 51, moisture sensor 50, motor 54, inlet valve 70, pumps 64, 66, steam generator 82 and fluid control valve 85 to either control these components and/or receive their input for use in controlling the components. The controller 14 is also operably coupled to the user interface 16 to receive input from the user through the user interface 16 for the implementation of the drying cycle and provide the user with information regarding the drying cycle.

A user interface 16 may be provided having operational controls such as dials, lights, knobs, levers, buttons, switches, and displays enabling the user to input commands to a controller 14 and receive information about a treatment cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, and Jeans.

The controller 14 may implement a treatment cycle selected by the user according to any options selected by the user and provide related information to the user. The controller 14 may also comprise a central processing unit (CPU) 74 and an associated memory 76 where various treatment cycles and associated data, such as look-up tables, may be stored. One or more software applications, such as an arrangement of executable commands/instructions may be stored in the memory and executed by the CPU 74 to implement the one or more treatment cycles.

In general, the controller 14 will execute a cycle of operation to effect a treating of the laundry in the treating chamber 34, which may or may not include drying. The controller 14 may actuate the blower assembly 46 to draw an inlet air flow 58 into the supply conduit 38 through the rear vent 37 when air flow is needed for a selected treating cycle. The controller 14 may activate the heating element 42 to heat the inlet air flow 58 as it passes over the heating element 42, with the heated air 59 being supplied to the treating chamber 34. The heated air 59 may be in contact with a laundry load 36 as it passes through the treating chamber 34 on its way to the exhaust conduit 44 to effect removal of moisture from the laundry. The heated air 59 may exit the treating chamber 34, and flow through the blower assembly 46 and the exhaust conduit 44 to the outside of the clothes dryer 10. The controller 14 continues the cycle of operation until completed. If the cycle of operation includes drying, the controller 14 determines when the laundry is dry. The determination of a "dry" load may be made in different ways, but is often based on the moisture content of the laundry, which is typically set by the user based on the selected cycle, an option to the selected cycle, or a user-defined preference.

During a cycle of operation, the blower assembly 46 may generate an audible sound. As can be seen by reference to FIG. 3, the blower assembly 46 comprises a motor 54 and a fan 94, either of which may be the source of undesired noise. For example, a four-pole, split-phase motor is often the motor used in such a blower configuration because of its low cost. However, such motors may have a relatively high level of audible sound, as compared to other types of motors, in sound bands of concern for dryer operation, such as in the 125 Hz, One-third Octave band, which may be typically the loudest and highest variation frequency band for the clothes dryer 10. Generally a high level of audible sound is not desirable, and should be minimized for the sake of a user.

The four-pole, split-phase motor tends to have a very simple controller, which makes it cost effective, but such a motor has a pulsating field, whose sound is audible to the user. It has been found that the mass of the fan 94 may be used as an inertial device to modify the pulsing action of the motor 54, and correspondingly reduce the overall sound and/or level of the audible sound generated from the motor 54. The invention addresses the problem of high sound levels generated during the operation of the motor 54 in the clothes dryer 10 by integrating an inertial weight to the wheel 95 to retard the generation and propagation of the sound from the motor 54.

Figure 3:
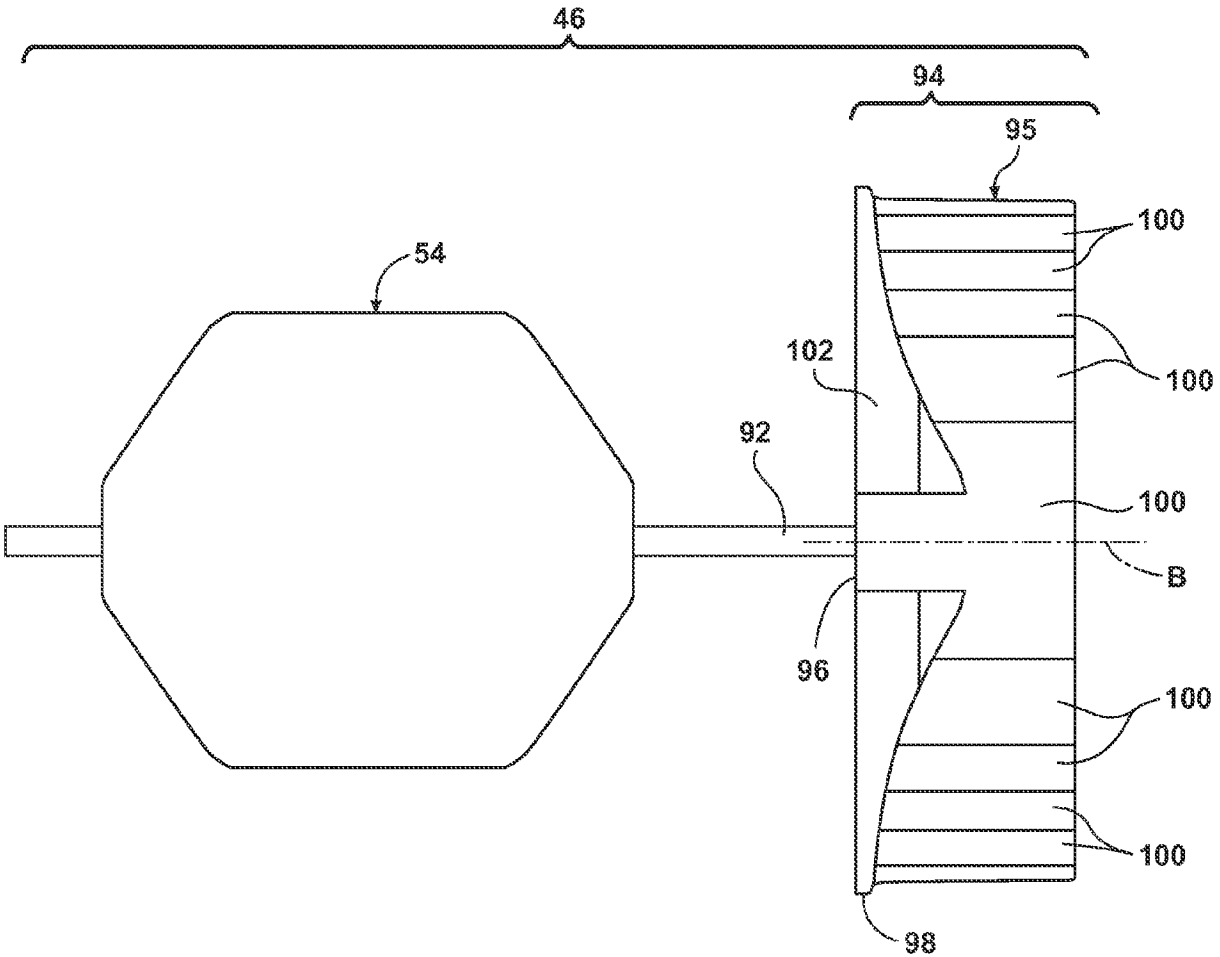
FIG. 3 is a schematic side view of a blower assembly of the clothes dryer in FIG. 1.

FIG. 3 is a schematic, side view of the blower assembly 46 where the fan 94 is configured and coupled to the motor 54 so as to reduce the overall sound and/or level of the sound by reducing the pulsing of the motor 54. The motor 54 has an output shaft 92 on which the fan 94 is mounted to effect the rotation of the fan 94. The motor 54 mounted to the output shaft 92 and the output shaft 92 may operably couple to and extend from the electric motor 54 in a horizontal direction.

The fan 94 may include a wheel 95 having a central hub 96 and a peripheral rim 98 from which a plurality of vanes 100 project. An inertial weight 102 may be mounted to or integrally formed with the wheel 95. A centerline B passing through the central hub 96 may define an axis of rotation of the wheel 95 with respect to the output shaft 92.

Figure 4:
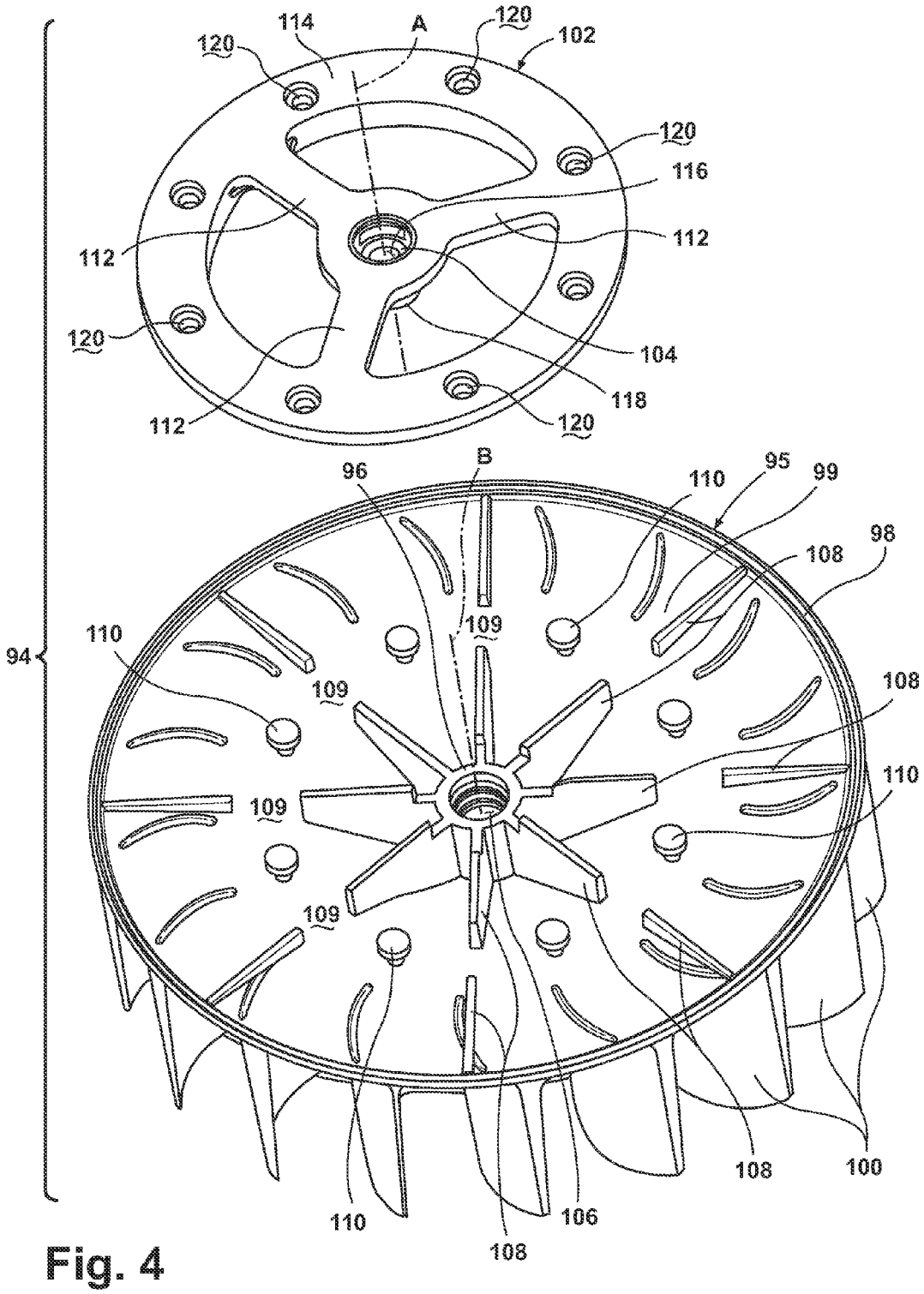
FIG. 4 is an exploded view of an inertial weight and wheel of the blower assembly in FIG. 3.

FIG. 4 is an exploded view of the wheel 95 and inertial weight 102 to illustrate their relationship. As illustrated, the wheel 95 may include a central hub 96 and a peripheral rim 98, which are connected by a disk 99 that extends between the central hub 96 and the peripheral rim 98. The wheel 95 may be made from a polymer material suitable for various shaping process such as injection molding.

The disk 99 has two opposing sides, that is, a first side and a second side. The two opposing sides of the disk 99 need not have the same contour, nor does each side need to be flat. In contrast, one of the first and second sides may be concave while the other of the first and second sides may be convex. In another example, the disk 99 may be configured to have a hyperboloidal cross section.

The central hub 96 may be formed on one side of the wheel 95, and include an opening 106 which may be either a through opening or a closed opening. The opening 106 may have one or more grooves on the inner surface of the opening 106 for coupling. Alternatively, the opening 106 may include other coupling means such as threads or a keyway in the interior of the opening 106. The dimension of the opening 106 may be configured to receive the output shaft 92.

A plurality of spokes 108 may be formed on the same side of the wheel 95 on which the central hub 96 is formed. The plurality of spokes 108 may emanate from the central hub 96 radially toward the rim 98 of the wheel 95. As illustrated, all of the spokes 108 may not be continuous. The spokes 108 may have two portions leaving a discontinuity 109 while one-piece spoke may be also possible in another example. The discontinuity 109 is sized to receive a portion of the inertial weight 102.

A plurality of pins 110 may be generally formed on the same side of the wheel 95 on which the spokes 108 and the central hub 96 are positioned. The pins 100 function to couple the inertial weight 102 to the fan. The dimension and number of pins 110 may be determined based on the design of the inertial weight 102.

The overall dimension of the wheel 95 may vary, depending on the clothes dryer 10 to which the wheel 95 is operably coupled. In one example, the diameter of the wheel 95 may be approximately 220 mm with the width of the wheel 95 having approximately 50 mm.

The plurality of vanes 100 may be generally positioned on the other side of the wheel 95. At least some of the vanes 100 may project from the peripheral rim 98 toward the central hub 96. The plurality of vanes 100 may be radially spaced about the rim 98 by a predetermined spacing. Some of the vanes 100 may be shaped. For example, a portion of the vanes 100 may be rolled by a predetermined amount for controlled air flow.

The inertial weight 102, as illustrated, has a hub 104, spoke 112, and ring 114 configuration, and may be made from steel or other materials. The hub 104 may have an opening 116, which may be configured to receive the output shaft 92 and at the same time be received by the through opening 106 of the wheel 95. The hub 104 may also have a part 118 that may be received by the central hub 96 of the wheel 95. For example, the part 118 may be provided with one or more grooves that may match the grooves formed on the inner surface of the central hub 96 of the wheel 95. A centerline A of the opening 116 may define an axis of rotation of the inertial weight 102.

A plurality of openings 120 may be formed in the ring 114. The dimension of the openings 120 may be configured to match to the pins 110 formed on one side of the wheel 95. In this way, the pins 110 may be received by the openings 120 to mount the inertial weight 102 to the fan 94.

The dimensions of the inertial weight 102 may vary, and may be determined in conjunction of the weight requirements of motor and blower wheel system 46. In one example, the diameter of the inertial weight 102 may be approximately 125 mm, with the thickness of the inertial weight 102 being approximately 12-16 mm, leading to a total weight of the inertial weight 102 of approximately 0.75 Kg.

Figure 5:
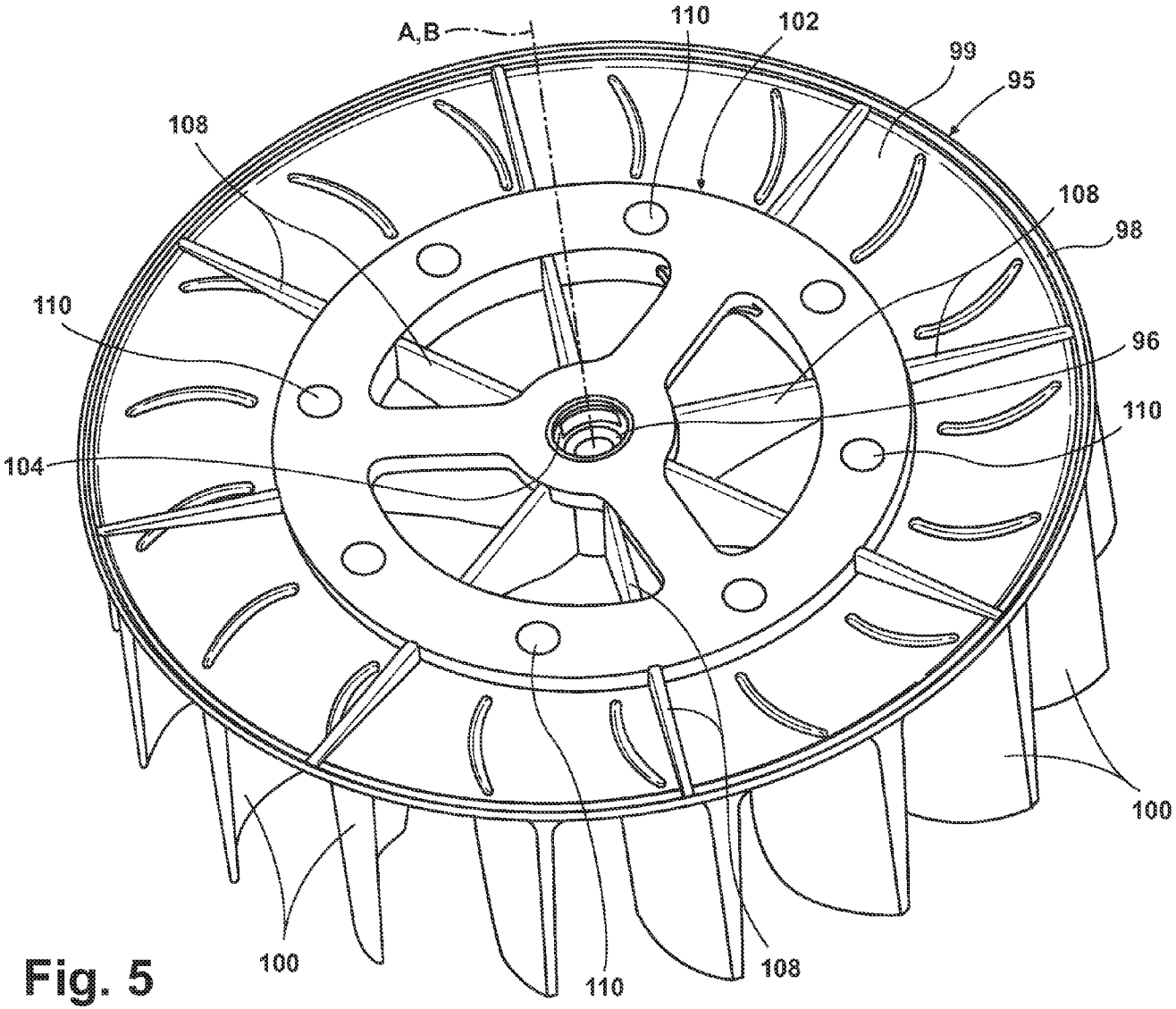
FIG. 5 is a perspective view of the inertial weight and wheel of the blower assembly in FIG. 3, illustrating the relative position of the inertial weight to the wheel after the inertial weight and the wheel are assembled.

FIG. 5 is a perspective view of the inertial weight 102 and the wheel 95, illustrating the relative position of the inertial weight 102 to the wheel 95 after the inertial weight 102 and the wheel 95 are assembled. Typically the inertial weight 102 may be coupled to the side of the wheel 95 on which the plurality of spokes 108 is emanated and the central hub 96 is formed. The hub 104 of the inertial weight 102 may be located adjacent the central hub 96 of the wheel 95 until a portion of the part 118 (not shown) is received by the central hub 96 of the wheel 95. The inertial weight 102 may be received by discontinuities 119 formed on the wheel 95. The inertial weight 102 may be adjusted about a center line A of the hub 104 until the pins 110 on the wheel 95 are received by the openings 120 of the inertial weight 102. It is noted that the centerline A of the inertial weight 102 may be configured to coincide with the centerline B of the wheel 95 for a concentric rotation of the inertial weight 102 and the wheel 95 during the operation of the blower assembly 46 to reduce the pulsing action of the motor 54.

Figure 6:
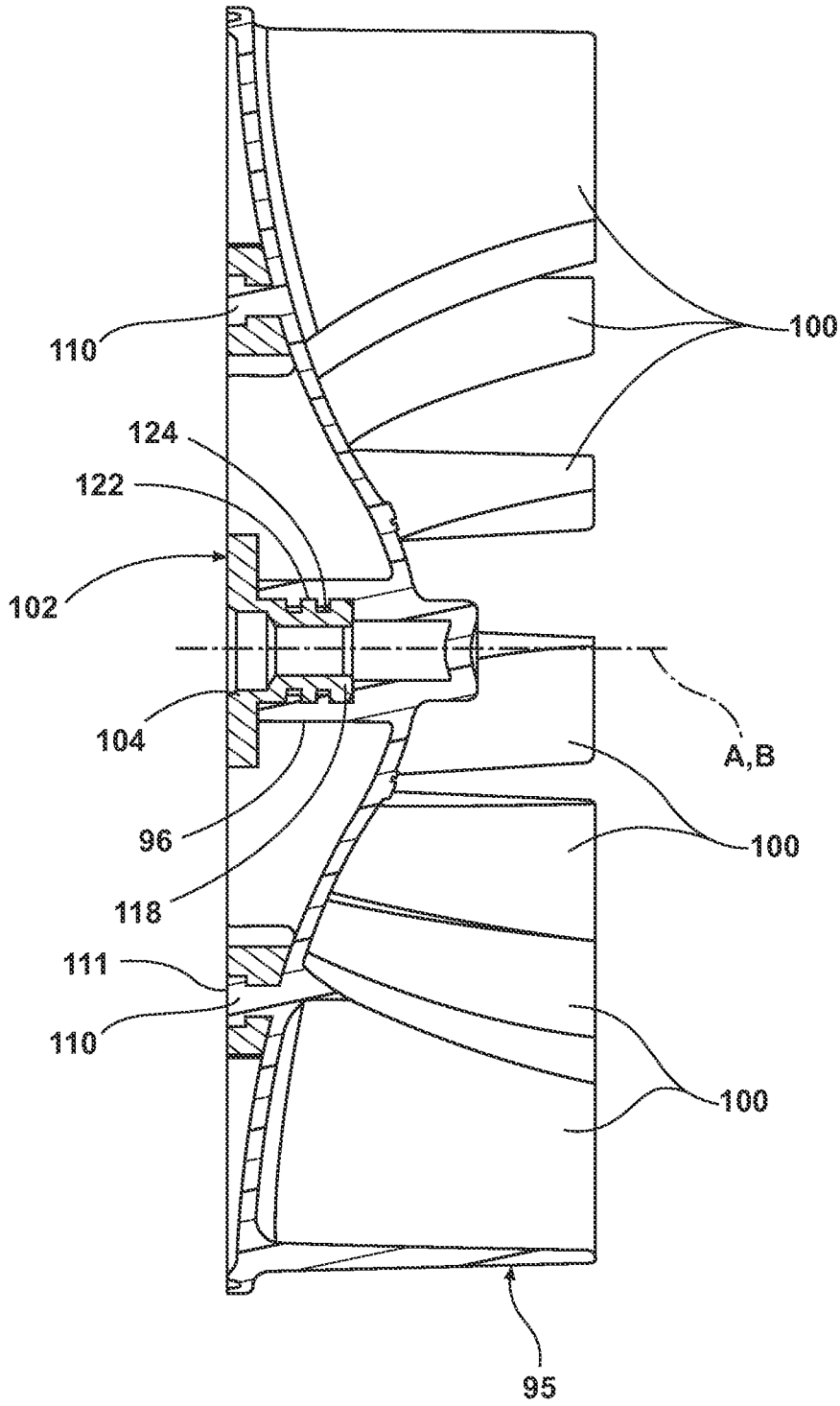
FIG. 6 is a cross-sectional view of the inertial weight and wheel of the blower assembly in FIG. 3, with the inertial weight and wheel integrated by insert molding.

As best seen with reference to FIG. 6, the inertial weight 102 may be integrally formed with the wheel 95 to provide the relatively positioning of the weight 102 and the wheel. The integration of the wheel 95 with the inertial weight 102 may be accomplished by a molding process such as insert molding. The inertial weight 102 may be placed in the mold which is shaped to form the wheel 95. An appropriate polymer material forming the wheel 95 may be filled into the mold where the inertial weight 102 is already placed. The insert molding may be performed under a predetermined temperature and pressure to ensure the flow of the polymer material with respect to the inertial weight 102 to integrate the wheel 95 with the inertial weight 102. The insert molding may be advantageous in securely coupling the inertial weight 102 to the wheel 95.

The inertial weight described herein may be integrated to the wheel to provide inertia with a predetermined mass to the wheel. The wheel integrated with the inertial weight may be operably coupled to any variable speed motor to reduce the pulsing action of the motor. As a result, the generation and propagation of audible sound from the motor may be significantly reduced. Further, the integration of the inertial weight with the wheel may simplify the maintenance and upgrade of the blower assembly.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A blower assembly, comprising:

an electric dryer motor with an output shaft;

a wheel having a central hub and a peripheral rim, with the hub having a through opening receiving the output shaft of the motor, and a centerline of the opening defining an axis of rotation of the wheel;

a plurality of vanes projecting from the rim and spaced radially about the rim; and an inertial weight mounted to the wheel and circumscribing the hub and having at least a portion radially spaced from the axis of rotation.

2. The blower assembly of claim 1 wherein the wheel comprises opposing first and second sides that extend from the rim to the hub.

3. The blower assembly of claim 2 wherein at least some of the vanes extend along one of the first and second sides.

4. The blower assembly of claim 3 wherein the inertial weight is mounted to the other of the first and second sides.

5. The blower assembly of claim 4 wherein the inertial weight comprises a ring.

6. The blower assembly of claim 5 wherein the wheel comprises spokes emanating from the hub on the other of the first and second sides and the ring circumscribes the spokes to position the inertial weight relative to the wheel when the inertial weight is mounted to the wheel.

7. The blower assembly of claim 6 wherein the wheel comprises pins extending from the other of the first and second side and the ring comprises openings for receiving the pins to mount the inertial weight to the wheel.

8. The blower assembly of claim 4 wherein the inertial weight comprises a hub having a centerline and spokes extending from the hub to a ring, wherein the ring is mounted to the wheel such that the centerline of the inertial weight is coaxial with the centerline of the wheel.

9. The blower assembly of claim 8 wherein the hub of the inertial weight has a portion that is received within the hub of the wheel.

10. The blower assembly of claim 9 wherein the one of the first and second sides is convex and the other of the first and second sides is concave.

11. The blower assembly of claim 10 wherein the inertial weight is integrally formed with the wheel by injection molding.

12. The blower assembly of claim 10 wherein at least some of the vanes project laterally from the peripheral rim.

13. The blower assembly of claim 1 wherein at least some of the vanes project from the rim toward the hub.

14. The blower assembly of claim 13 wherein the wheel comprises a disk extending between the rim and the hub and at least some of the vanes extend along the disk.

15. The blower assembly of claim 14 wherein the disk has a hyperboloidal cross section.

16. The blower assembly of claim 1 wherein the inertial weight comprises a ring circumscribing and spaced from the hub.

17. The blower assembly of claim 16 wherein the inertial weight further comprises a hub having a centerline and spokes extending from the hub to the ring, wherein the inertial ring is mounted to the wheel such that the centerline of the inertial weight is coaxial with the centerline of the wheel.

18. The blower assembly of claim 17 wherein the hub of the inertial weight has a portion that is received within the hub of the wheel.

19. The blower assembly of claim 1 wherein the electric motor is a variable speed motor.

20. The blower assembly of claim 19 wherein the inertia of the inertial weight is set to retard the pulsation of a four-pole, split-phase electric motor that results in sound for a 125 Hz One-third Octave band center frequency for sound power.

* * * * *